United States Patent [19]

Infanti

[11] Patent Number: 4,593,950

[45] Date of Patent: Jun. 10, 1986

[54] COLLAPSIBLE COMBINED ROCKER AND CHAIR

[76] Inventor: Vittorio Infanti, 3075 Richmond Ter., Staten Island, N.Y. 10303

[21] Appl. No.: 489,482

[22] Filed: Apr. 28, 1983

[51] Int. Cl.[4] ..... A47C 13/00

[52] U.S. Cl. ..... 297/3; 297/130; 297/442

[58] Field of Search ..... 297/1-3, 297/442, 130, 131, 133

[56] References Cited

U.S. PATENT DOCUMENTS 2,269,834 1/1942 Wagner ..... 297/130 X 2,440,979 5/1949 Schneider ..... 297/3

2,776,700 1/1957 Potter et al. ..... 297/3

3,547,491 12/1970 Bovasso ..... 297/442

*Primary Examiner*—Kenneth Downey

*Attorney, Agent, or Firm*—Louis Weinstein

[57] ABSTRACT

A child's knock-down chair capable of being assembled without the need for any conventional fasteners and comprised of two side parts and two cross pieces which, due to the unique design of the chair, act respectively as seat and back for a steady chair, and as a back and seat for a rocking chair. Disassembly of the knock-down chair is as simple and straightforward as assembly.

6 Claims, 6 Drawing Figures

COLLAPSIBLE COMBINED ROCKER AND CHAIR

FIELD OF THE INVENTION

The present invention relates to a child's chair and, more particularly, to a knock-down chair capable of being simply and reaily assembled without the need for any conventional fastening means, and being designed to function as either a steady chair or a rocking chair, depending on chair orientation.

BACKGROUND OF THE INVENTION

Knock-down furniture is known to the prior art and is advantageous from the viewpoint of both shipment and storage, as well as size.

There are also chair designs known to the prior art which, in one orientation function is a steady chair and, in an alternative orientation, function as another type of chair, such as for example, a rocking chair.

It is, nevertheless, advantageous to provide a chair assembly of knock-down design capable of functioning as a plurality of different types of chairs, depending upon the orientation of the chair upon the supporting surface and which are capable of being simply and readily assembled and disassembled, without the need for conventional fasteners.

BRIEF DESCRIPTION OF THE INVENTION AND OBJECTS THEREOF

The present invention is characterized by comprising a knock-down chair assembly capable of multiple uses, depending upon its particular orientation and which, in addition to being simply and readily assembled and disassembled, is designed so as to remain in the assembled state without the need for any conventional fastening means whatsoever.

The present invention comprises a pair of substantially identical side pieces and a pair of cross pieces. All of said pieces are provided with elongated slots, for slidably interlocking the cross pieces with the side pieces. A projection along one edge of one of the cross pieces is arranged to extend into and be received by a slot in the remaining one of the cross pieces, which arrangement interlocks the cross pieces thereby retaining all four chair pieces in the assembled and locked condition.

The chair assembly, in one orientation is designed for use as a rocking chair while, in a second orientation is designed for use as a steady chair. Disassembly is as simple and straightforward as assembly. Each of the pieces of the chair assembly are flat pieces, thereby minimizing occupied volume and hence facilitating storage thereof.

It is, therefore, one object of the present invention to provide a novel knock-down chair assembly designed to facilitate simple, straightforward assembly and disassembly, which chair is retained in the assembled condition without the need for any conventional fasteners whatsoever.

Still another object of the present invention is to provide a chair assembly of the type described hereinabove, wherein the chair assembly is designed for use as a rocking chair in one orientation, and for use as a steady chair in another orientation.

The above, as well as other objects of the present invention, will become apparent when reading the accompanying description and drawing in which:

FIG. 1 shows a plan view of the chair assembly side piece designed in accordance with the principles of the present invention.

FIGS. 2*a* and 2*b* are plan view showing the two respective cross pieces of the chair assembly of the present invention.

DETAILED DESCRIPTION OF THE INVENTION

Considering FIGS. 1, 2*a*, 2*b* and 3, there is shown therein a chair assembly 10 designed in accordance with the principles of the present invention, and which is comprised of a pair of side pieces 12, 12 and cross pieces 14 and 16. Since the side pieces are identical in both design and function, only one such side piece has been shown in detail in FIG. 1 for purposes of simplicity. Also, since the side pieces are identical, they have been identified by identical numbers.

Figure 1:
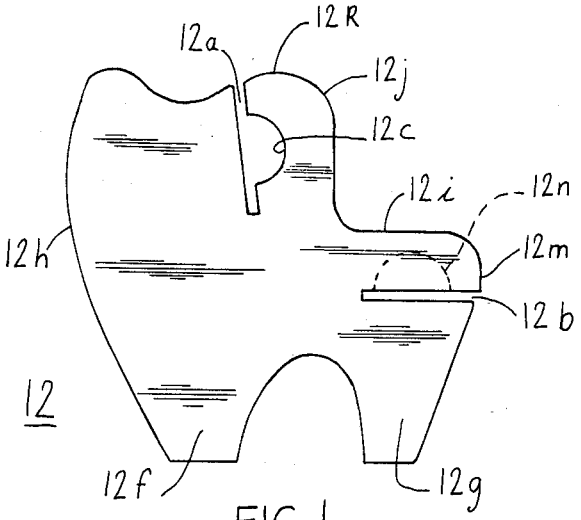
Figure 2A:
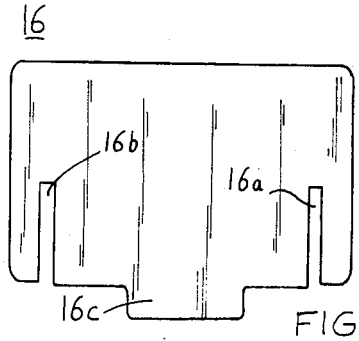
Figure 2B:
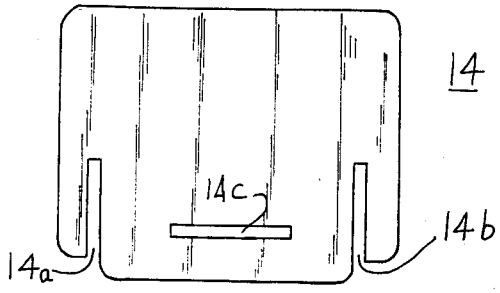
Figure 3:
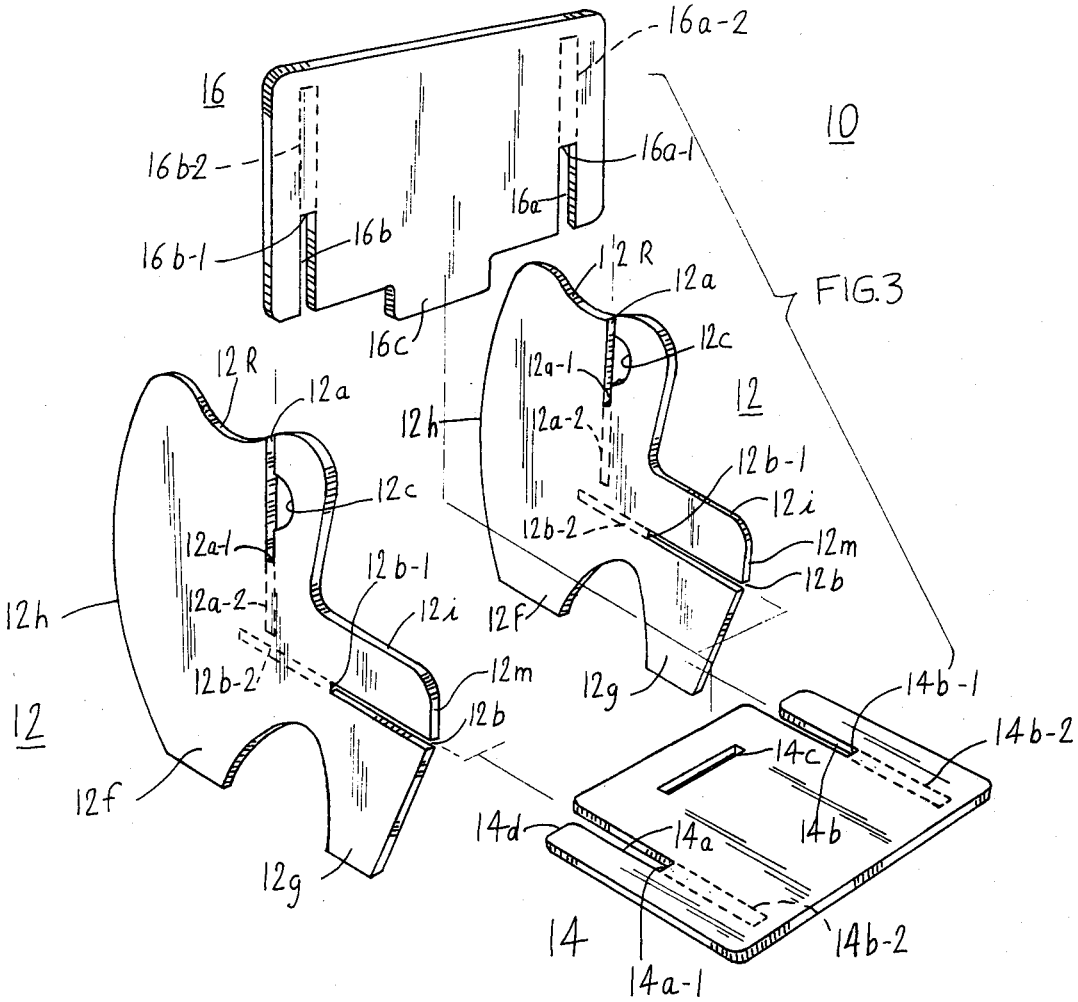
FIG. 3 shows an exploded perspective view of the chair assembly of the present invention embodying the side piece and cross pieces shown in FIGS. 1 and 2*a*–2*b*, respectively.

The side pieces 12, 12 when oriented in the manner shown in FIG. 3, are provided with vertically aligned elongated slots 12*a*, which communicate with top edges 12*k*, 12*k* and horizontally aligned slots 12*b*, 12*b*, which communicate with front edges 12*m*, 12*m*. The slots 12*a*, 12*a* are each provided with semi-circular cut-outs 12*c*, 12*c* along one edge of the slot, which semi-circular cut-outs 12*c*, 12*c* are arranged intermediate the ends of the elongated slots 12*a*, 12*a* and are provided to facilitate moving and handling of the chair assembly 10, as will be more fully described.

Side pieces 12, 12 are each provided with a pair of leg portions 12*f*, 12*g* and 12*f*, 12*g* and a curved supporting portion 12*h*, 12*h*, the legs 12*f*, 12*g* and 12*f*, 12*g* supporting the chair assembly 10 in a steady fashion, when oriented in the manner shown in FIG. 4, while the curved edges 12*h*, 12*h* serve to rockingly support the chair assembly 10, when oriented in the manner shown in FIG. 5, which orientations will be more fully described hereinbelow.

Side piece 14 is provided with a pair of elongated slots 14*a*, 14*b* which communicate with edges 14*d*, 14*e*, respectively, of cross piece 14. An elongated slot 14*c* is oriented at a right angle relative to slots 14*a* and 14*b*.

Slots 14*a*, 14*b* are designed to slidably interfit with slots 12*b*, 12*b* of side pieces 12, 12. Cross piece 14 interfits with side pieces 12, 12, so that, when fully assembled, the inner ends 14*a*-1 and 14*b*-1 of slots 14*a*, 14*b* rest against the inner ends 12*b*-1, 12*b*-1 of slots 12*b*, 12*b*. The bases of the aforementioned slots serve to properly fully interlock cross piece 14 with side pieces 12, 12, whereby the slots 14*a*, 14*b* embrace the portions 12*b*-2, 12*b*-2 of side pieces 12, 12, which portions are shown in dotted line fashion. Similarly, slots 12*b*, 12*b* embrace portions 14*a*-1, 14*b*-1 of cross piece 14, shown in dotted line fashion, and which are arranged beyond slots 14*a* and 14*b*, respectively. Slots 14*a*, 14*b* limit a sidewise movement of side plates 12, 12 and, similarly, slots 12*b*, 12*b* prevent any upward or downward lateral movement of cross piece 14.

In a similar fashion, cross piece 16 is provided with a pair of elongated slots 16*a* and 16*b*, which terminate along edge 16*c*. An elongated projection 16*d* extends beyond edge 16*c* and is centrally located therealong. Slots 16*a* and 16*b* slidably interengage slots 12*a*, 12*a* of slide plates 12, 12 and in a manner similar to that described in connection with cross piece 14. The cross piece 16 is properly positioned when the bases 16*a*-1, 16*b*-1 of slots 16*a* and 16*b* rest against the bases 12*a*-1, 12*a*-1 of slots 12*a*, 12*a*. The slots 16*a*, 16*b* embrace portions 12*a*-2, 12*a*-2 of side plates 12, 12, as shown in dotted fashion, while slots 12*a*, 12*a* embrace portions 16*a*-2, 16*b*-2 of cross piece 16. Slots 16*a*, 16*b* prevent any sidewise movement of side plates 12, 12, while slots 12*a*, 12*a* prevent any lateral movement of cross piece 16 when the chair assembly 10 is oriented in the manner shown in FIG. 3.

As the cross piece 16 is moved downwardly into position, its projection 16*d* slides into slot 14*c*. Slot 14*c* thus embraces the dotted line portion 16*e* of cross piece 16, preventing cross piece 14 from being removed from the side pieces 12, 12.

Figure 4:
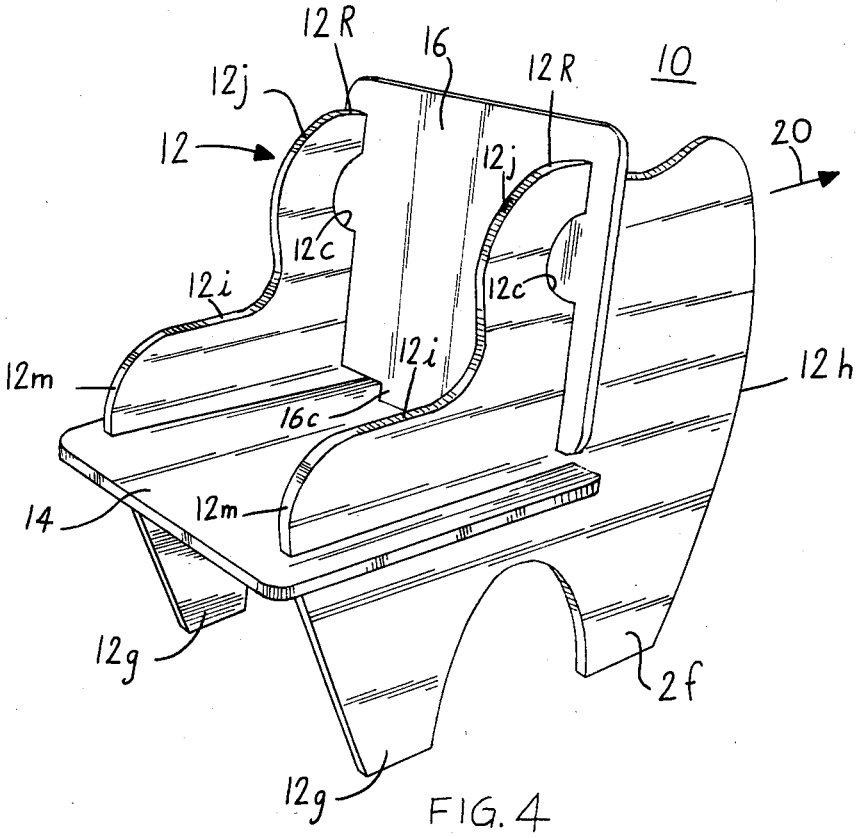
FIG. 4 is a perspective view showing the manner in which the chair assembly of FIG. 3 may be oriented for use as a steady chair.

With the chair assembly 10 in the position shown in FIG. 4, the force of gravity serves to retain cross piece 16 in its fully assembled position. In the orientation shown in FIG. 4, cross piece 14 serves as the chair seat, while cross piece 16 serves as the chair back. Legs 12*g*, 12*g* and 12*f*, 12*f* serve to support the chair in steady fashion upon a suitable supporting surface, such as for example, a floor. Edges 12*i*, 12*i* provide arm rests. The portion of side plates 12, 12 adjacent edges 12*j* 12*j* serve as side portions for supporting the sides and shoulders, for example, of a child seated within chair 10.

Figure 5:
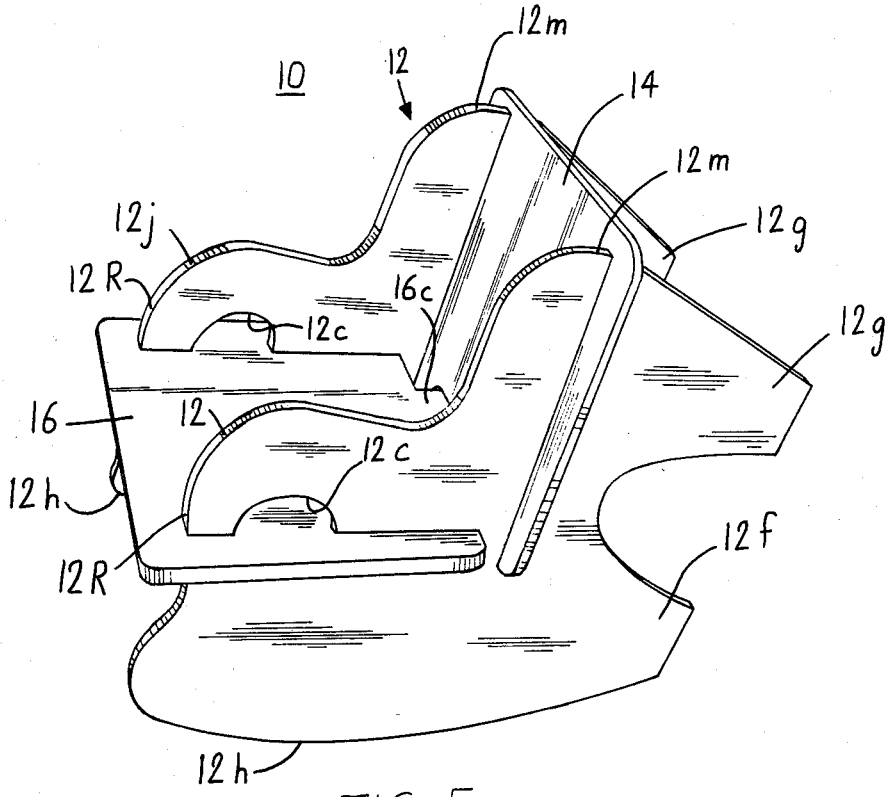
FIG. 5 shows a perspective view the chair assembly of FIGS. 3 and 4, which is oriented for use as a rocking chair.

By tilting chair assembly 10, as shown in FIG. 4, in the direction shown by arrow 20, the chair assembly 10 may be oriented in the manner shown in FIG. 5 to serve as a rocking chair, whereby curved edges 12*h*, 12*h* serve to rockingly support the chair assembly 10 upon a floor, or any other suitable supporting, surface. Edges 12*j*, 12*j* of side plates 12, 12 function as arm rests while portions of side plates 12, 12 adjacent to edges 12*i*, 12*i* function as side portions to support the sides and shoulders of a child to prevent a child from falling out of the rocking chair. The semi-circular cut-outs 12*c*, 12*c* facilitate moving or sliding of the chair from place to place, as well as facilitating tilting of the chair from either one of its two orientations to the other. If desired, slots 12*b*, 12*b* may likewise be provided with semi-circular cut-outs 12*n*, shown in dotted fashion in FIG. 1, to facilitate movement and re-orientation of the chair assembly 10.

It should further be noted that edges 14*d*, 14*e* of cross pieces 14 bear against the top surface of cross piece 16 to retain it in position, and thereby prevent the chair assembly from being disassembled when in normal use.

In order to disassemble the chair, cross piece 16 is lifted upwardly from the assembled position to remove projection 16*d* from slot 14*c*. Thereupon, either cross piece 16 may be removed completely from side pieces 12 or cross piece 14 may be removed side piece 12 at that time, whereupon the entire assembly is easily and readily disassembled. All of the chair pieces 12, 12, 14 and 16 are flat, thereby facilitating their placement one upon the other in a compact fashion to minimize the space required for storage and/or transportation of the knock-down chair assembly 10.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A knock-down chair assembly composed of only four members:

said four members including a pair of identical side pieces and first and second cross pieces;

said side pieces each having a pair of slots communicating with adjacent edges of said side pieces and arranged so that they are oriented substantially at an angle greater than a right angle relative to one another;

said first cross piece having a pair of spaced parallel slots communicating with one edge thereof, and a third slot arranged parallel to and inwardly from said one edge and substantially perpendicular to said pair of slots;

said second cross piece having a pair of slots communicating with one edge thereof and being arranged in spaced parallel fashion;

said second cross piece having an integral elongated projection extending outwardly from said one edge;

the pair of slots of said first cross piece and an associated one of said pair of slots of said side pieces, each slidably receiving one another and extending beyond the slots so that the slots in said side pieces each embrace a portion of said cross piece beyond the parallel slots in the cross piece, and so that the elongated slots in said first cross piece each embrace a portion of one of said side pieces beyond the slots in said side pieces cooperating with the parallel slots in said first cross piece;

the pair of elongated slots in said second cross piece each being slidably received by an associated one of the remaining slots in said side pieces, so that the slots in said second cross piece each embrace a portion of the side pieces beyond the slots received thereby, and so that the remaining slots of said side pieces each embrace a portion of the second cross piece beyond the slots therein;

said third elongated slot in said first cross piece receiving the integral projection of said second cross piece for interlocking said cross pieces to one another and hence, for interlocking said first and second cross pieces and said side pieces;

said side pieces each having an elongated curved side edge, said curved side edge cooperating to rockingly support said chair assembly, whereby said first and second cross pieces, respectively, serve as the rocking chair back and rocking chair seat;

said side pieces each having a pair of integral projections forming a pair of legs along an edge adjacent to and aligned transverse to the curved side edges, said side pieces collectively thereby providing four such legs for supporting said chair assembly when the free ends of such legs rest upon a supporting surface, thereby providing a steady chair.

2. The chair assembly of claim 1, wherein first and second portions of said side pieces serve as arm rests when the elongated curved side edges engage a support surface.

3. The chair assembly of claim 1, wherein said side plates are each provided with first and second portions serving as arm rests, when the aforementioned integral projections of said first and second side plates are resting upon a supporting surface.

4. The chair assembly of claim 1, wherein at least one of the elongated slots of each of said side plates includes a substantially semi-circular shaped cut-out portions, said cut-out portions serving as hand grips to facilitate use and transportation of said chair assembly.

5. The chair assembly of claim 1, wherein said cross pieces and said side plates are each formed from a substantially flat sheet of a suitable rigid material.

6. The chair assembly of claim 5, wherein said rigid material is taken from the group consisting of wood and plastic.

* * * * *